US006324784B1

(12) United States Patent
Bina

(10) Patent No.: US 6,324,784 B1
(45) Date of Patent: Dec. 4, 2001

(54) FLOWER HOLDING SYSTEM

(76) Inventor: Leonard E. Bina, 1514 S. 15th St., Grand Forks, ND (US) 58201-5324

( * ) Notice: Subject to any disclaimer, the term of this patent is extended or adjusted under 35 U.S.C. 154(b) by 0 days.

(21) Appl. No.: 09/472,525

(22) Filed: Dec. 27, 1999

(51) Int. Cl.[7] ..... A01G 5/00
(52) U.S. Cl. ..... 47/41.01
(58) Field of Search ..... 47/41.01, 41.11; 428/23; 248/27.8, 205.3, 314

(56) References Cited

U.S. PATENT DOCUMENTS

| | | | | |
|---|---|---|---|---|
| D. 69,681 | * | 3/1926 | Weller | 47/41.01 |
| 272,446 | * | 2/1883 | Kidder | 248/27.8 |
| 1,063,709 | * | 6/1913 | Marsden | 47/41.01 |
| 1,074,239 | * | 9/1913 | Braun | 47/41.01 |
| 1,765,140 | * | 6/1930 | Fitl | 47/41.01 |
| 2,695,152 | * | 11/1954 | Parulski | 248/27.8 |
| 3,164,343 | * | 1/1965 | Cucullo | 248/27.8 |
| 3,261,126 | * | 7/1966 | Marks | 248/27.8 |
| 4,418,496 | * | 12/1983 | Koistinen | 47/41.12 |
| 6,067,748 | * | 5/2000 | Williams | 47/41.01 |

* cited by examiner

*Primary Examiner*—Thomas Price

(57) ABSTRACT

A flower holding system for supporting flowers upon a headstone for reducing debris about a gravesite. The inventive device includes a holder having a body, a neck and a base. The neck extends orthogonally from the base to support the holder in an upright position. The holder includes a cavity for receiving an elongate object such as flowers. The base includes a length of adhesive tape for securing to a flat surface such as a headstone or wall. The holder may be comprised of various materials and may includes various textures to conform to various designs of headstones.

6 Claims, 4 Drawing Sheets

FLOWER HOLDING SYSTEM

BACKGROUND OF THE INVENTION

1. Field of the Invention

The present invention relates generally to flower retaining devices and more specifically it relates to a flower holding system for supporting flowers upon a headstone for reducing debris about a gravesite.

Many individuals position flowers and other articles upon the gravesites of loved ones. However, most cemeteries do not want flowers planted nor placed upon the gravesites because they interfere with the mowing and general upkeep of the cemetery. Some cemeteries have taken the drastic action of banning flowers from gravesites which angers some visitors to the cemeteries. Hence, there is a need for a structure that will support flowers about a gravesite so as to not interfere with the general maintenance of the cemetery.

2. Description of the Prior Art

Flower holders for gravesites have been in use for years. Typically, the flower holders are comprised of a tubular retainer structure with a stake attached to the bottom for insertion into the ground surface. The user positions the flowers within the tubular retainer and inserts the stake portion into the ground surface. However, this significantly interferes with the maintenance of the cemetery and requires the groundskeeper to manually remove the flowers prior to mowing the grass.

While these devices may be suitable for the particular purpose to which they address, they are not as suitable for supporting flowers upon a headstone for reducing debris about a gravesite. Conventional devices for retaining flowers significantly interfere with the maintenance of cemeteries.

In these respects, the flower holding system according to the present invention substantially departs from the conventional concepts and designs of the prior art, and in so doing provides an apparatus primarily developed for the purpose of supporting flowers upon a headstone for reducing debris about a gravesite.

SUMMARY OF THE INVENTION

In view of the foregoing disadvantages inherent in the known types of flower holders now present in the prior art, the present invention provides a new flower holding system construction wherein the same can be utilized for supporting flowers upon a headstone for reducing debris about a gravesite.

The general purpose of the present invention, which will be described subsequently in greater detail, is to provide a new flower holding system that has many of the advantages of the flower holders mentioned heretofore and many novel features that result in a new flower holding system which is not anticipated, rendered obvious, suggested, or even implied by any of the prior art flower holders, either alone or in any combination thereof.

To attain this, the present invention generally comprises a holder having a body, a neck and a base. The neck extends orthogonally from the base to support the holder in an upright position. The holder includes a cavity for receiving an elongate object such as flowers. The base includes a length of adhesive tape for securing to a flat surface such as a headstone or wall. The holder may be comprised of various materials and may include various textures to conform to various designs of headstones.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a flower holding system that will overcome the shortcomings of the prior art devices.

A second object is to provide a flower holding system for supporting flowers upon a headstone for reducing debris about a gravesite.

Another object is to provide a flower holding system that significantly reduces the time required to perform maintenance tasks within a cemetery.

An additional object is to provide a flower holding system that increases the aesthetics of the cemetery.

A further object is to provide a flower holding system that can be attached to any flat structure such as a headstone or wall.

Another object is to provide a flower holding system that effectively supports flowers and other items commonly placed upon a gravesite.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
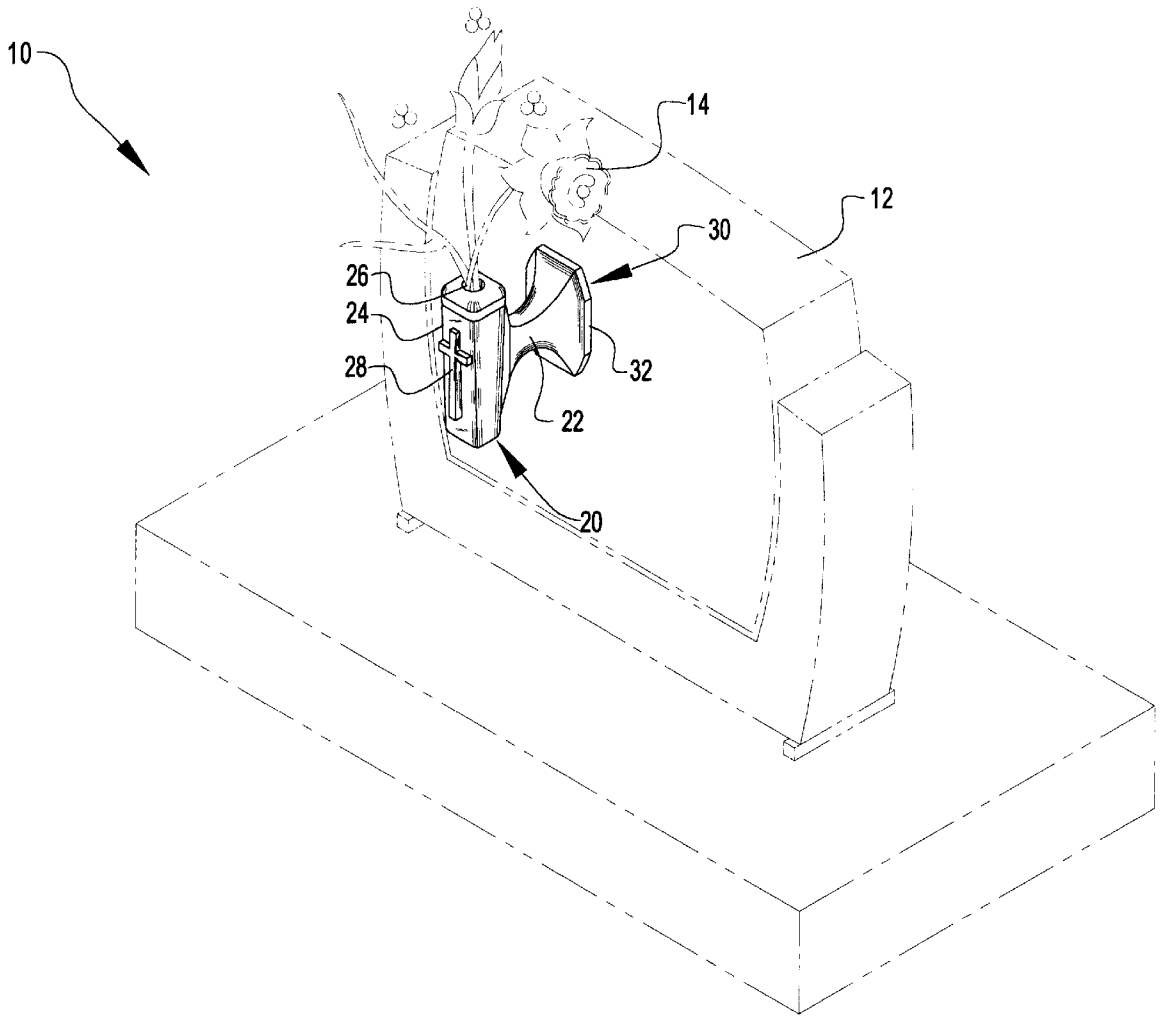
FIG. 1 is an upper perspective view of the present invention attached to a headstone.

Turning now descriptively to the drawings, in which similar reference characters denote similar elements throughout the several views, FIGS. 1 through 4 illustrate a flower holding system 10, which comprises a holder 20 having a body 24 and a neck 22. The neck 22 extends orthogonally from a base 30 to support the holder 20 in an upright position. The holder 20 includes a cavity 26 for receiving an elongate object such as flowers 14. The base 30 includes a length of adhesive tape 34 for securing to a flat surface such as a headstone 12 or wall. The holder 20 may be comprised of various materials and may includes various textures to conform to various designs of headstone 12s.

Figure 2:
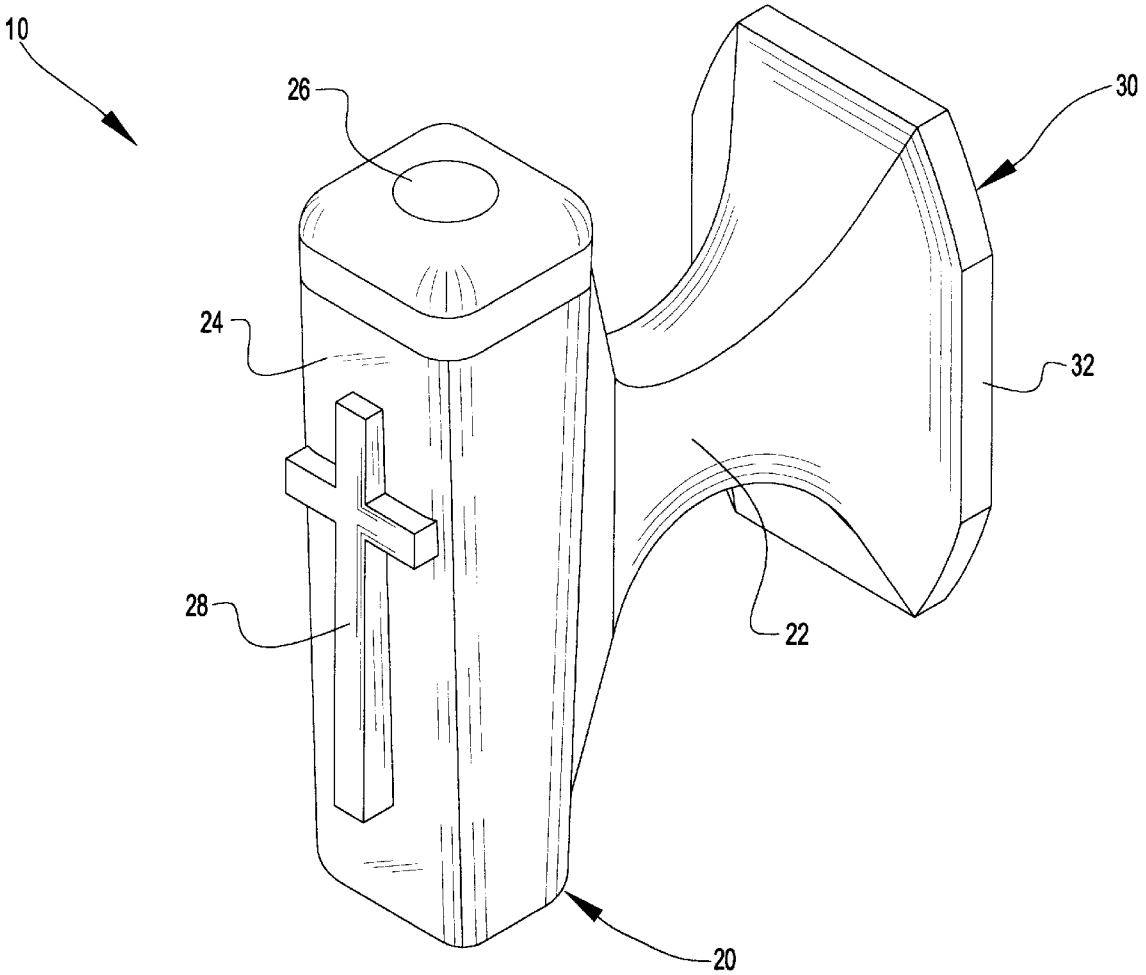
FIG. 2 is an upper perspective view of the present invention.
Figure 3:
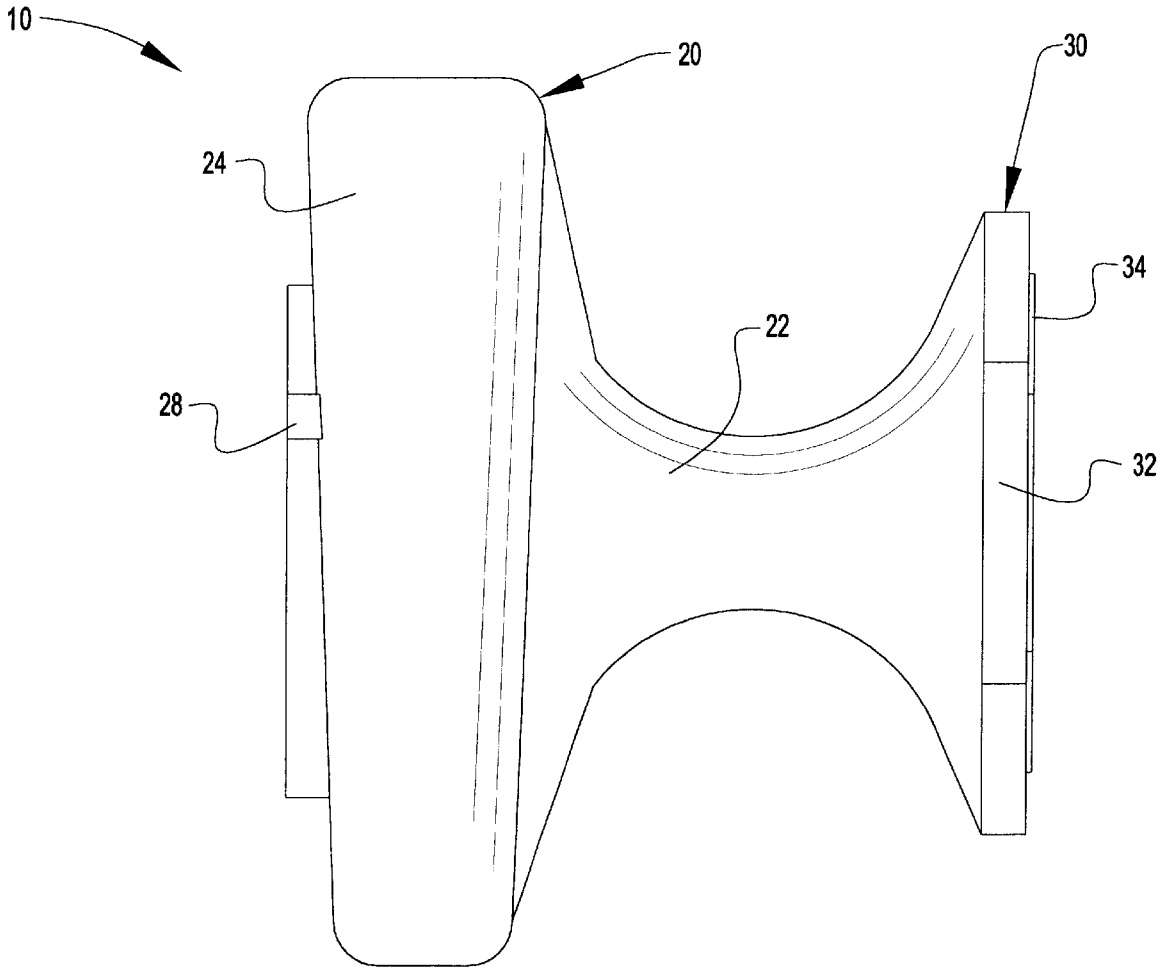
FIG. 3 is a side view of the present invention.

As shown in FIGS. 1 through 3 of the drawings, the holder 20 is formed into a decorative shape to aesthetically fit within the setting of the headstone 12. The holder 20 includes an elongate neck 22 extending from the base 30. The holder 20 further includes a body 24 attached to the neck 22 opposite of the base 30 for supporting an elongated structure such as flowers 14 or other item.

Figure 4:
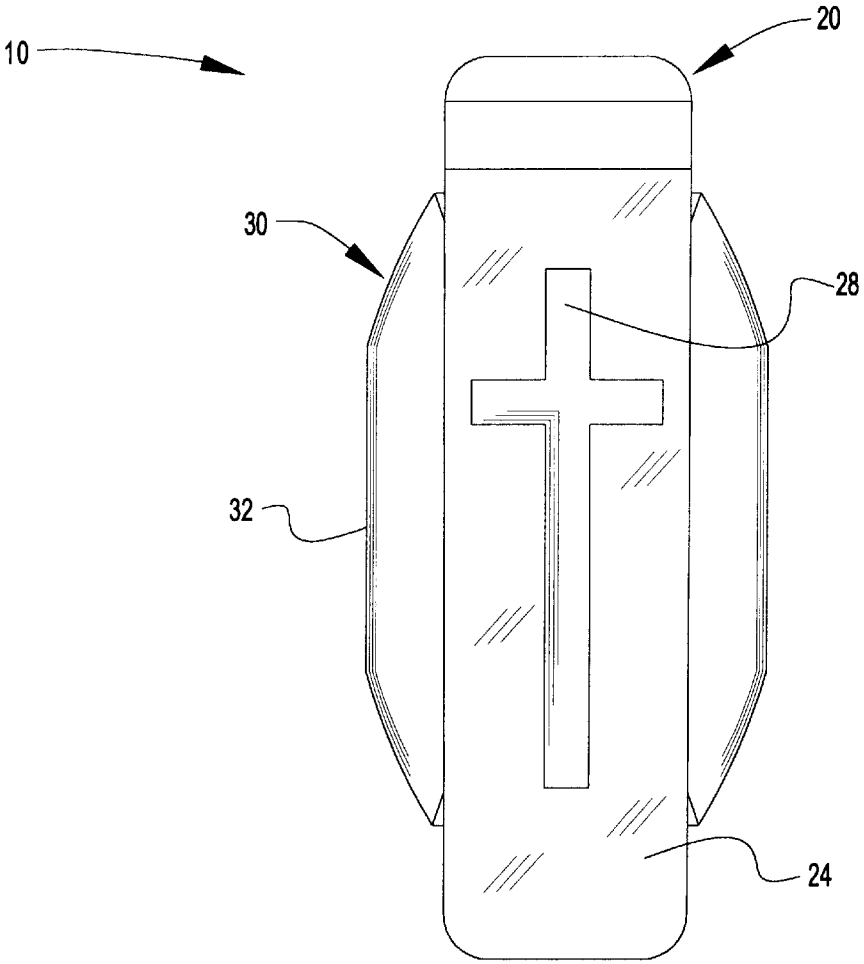
FIG. 4 is a front view of the present invention.

As shown in FIGS. 1 through 4 of the drawings, the body 24 is preferably vertically orientated. The body 24 includes a cavity 26 that preferably extends centrally within the body 24. The cavity 26 may be tapered or have a constant diameter. The cavity 26 is preferably large enough to receive flowers 14 or other elongate structure. The body 24 may include a decoration 28 as best shown in FIGS. 2 and 4 of the drawings. The body 24 may also be textured to conform to the texture of the headstone 12.

As can be appreciated, the base 30 may have any well-known shape such as rectangular or circular. The base 30 includes a swaged surface 32 that receives a length of adhesive tape 34 for attaching to a flat surface such as a headstone 12 or a wall.

As shown in FIG. 3 of the drawings, a length of adhesive tape 34 is attached to the swaged surface 32 of the base 30. The adhesive tape 34 is preferably double sided. The protective cover of the adhesive tape 34 is removed for allowing the invention to be attached to a flat surface such as a headstone 12.

In use, the user determines the location upon the headstone 12 that they desire to attach the present invention to. The user then removes the protective cover from the adhesive tape 34 thereby exposing the adhesive surface. The user then manually positions the invention so that the adhesive tape 34 engages and secures to the surface of the headstone 12 or wall. The user then may position flowers 14 or other items within the holder 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flower holding system, comprising:

a base having a vertically elongate body having a pair of side edges parallel to a longitudinal axis of said vertically orientated body, wherein said side edges are vertically aligned parallel to one another for assisting a user in vertically aligning said base to a monument and wherein said base includes a flat rear surface;

a length of adhesive tape attached to said flat rear surface of said base for securing said base to the monument; and a holder attached to said base formed for receiving a plurality of elongate and narrow objects.

2. The flower holding system of claim 1, wherein said length of adhesive tape is double sided.

3. The flower holding system of claim 2, including a neck extending between said base and said holder.

4. The flower holding system of claim 3, wherein said holder includes a cavity extending into an upper surface for receiving an object.

5. The flower holding system of claim 4, wherein said holder includes a decoration.

6. A flower holding system, comprising:

a base having a vertically elongate body having a pair of side edges parallel to a longitudinal axis of said vertically orientated body, wherein said side edges are vertically aligned parallel to one another for assisting a user in vertically aligning said base to a monument and wherein said base includes a flat rear surface;

a length of adhesive tape attached to said flat rear surface of said base for securing said base to the monument, wherein said length of adhesive tape is double sided;

a neck extending from said base opposite of said flat rear surface, wherein said neck tapers inwardly from said base and then tapers outwardly toward a distal end thereof; and a holder having a vertically orientated rectangular body attached to said neck opposite of said base, wherein said holder includes a vertically orientated cavity extending into an upper surface of said holder formed for receiving a plurality of elongate and narrow objects, and wherein said holder includes a decoration on a front surface thereof, and wherein said holder includes a pair of opposing sides that are parallel to one another and parallel to said side edges of said base.

* * * * *